United States Patent [19]

Walkhoff

[11] Patent Number: 4,937,953

[45] Date of Patent: Jul. 3, 1990

[54] SKI BOOT

[75] Inventor: Klaus Walkhoff, Kreuzlingen, Switzerland

[73] Assignee: Raichle Sportschuh AG, Kreuzlingen, Switzerland

[21] Appl. No.: 272,506

[22] Filed: Nov. 16, 1988

[30] Foreign Application Priority Data

Nov. 20, 1987 [CH] Switzerland ..... 04533/87

[51] Int. Cl.[5] ..... A43B 5/04

[52] U.S. Cl. ..... 36/119; 36/117; 36/54

[58] Field of Search ..... 36/117–121, 36/54, 55

[56] References Cited

U.S. PATENT DOCUMENTS

| | | | |
|---|---|---|---|
| 4,583,306 | 4/1986 | Paris | 36/119 |
| 4,590,691 | 5/1986 | Oliviero | 36/119 |
| 4,719,670 | 1/1988 | Kurt | 36/119 X |
| 4,788,782 | 12/1988 | Pozzebon et al. | 36/119 |
| 4,823,485 | 4/1989 | Kemmer | 36/119 |

FOREIGN PATENT DOCUMENTS

| | | | |
|---|---|---|---|
| 0169190 | 1/1986 | European Pat. Off. | 36/119 |
| 0278281 | 8/1988 | European Pat. Off. | 36/117 |
| 8702920 | 7/1987 | Fed. Rep. of Germany . | |
| 3736931 | 6/1988 | Fed. Rep. of Germany | 36/117 |
| 2553634 | 10/1983 | France . | |
| 2593682 | 3/1987 | France . | |

*Primary Examiner*—Paul T. Sewell
*Assistant Examiner*—Andrew D. Meyers
*Attorney, Agent, or Firm*—Collard, Roe & Galgano

[57] ABSTRACT

There is provided a ski boot having two support elements arranged between the shaft and the inner show of the ski boot which overlap the region of the instep in the nature of a saddle. Each support element is engaged by a pulling element which in each case grips across the other support element and is extended to a rotary lock by way of a reversing element. The pulling elements can be wound in the rotary lock so that the inner shoe, within the region of the support elements is painlessly and snugly forced or pressed against the foot. The front end regions of the support elements are supported on a guide element with free displaceability in the lengthwise direction of the boot and transverse thereto. The spacing of the support elements from the boot shaft is adjustable transversely to the boot sole by means of an adjusting member.

20 Claims, 3 Drawing Sheets

SKI BOOT

The present invention relates to a sport shoe, in particular a ski boot having a sole, a shaft portion attached thereto, a cushioning, two support elements in the interior of the shaft overlapping the cushioning and one another longitudinally in a saddle-like manner in the instep region, and a clamping arrangement for displacing the support elements transversely relative to the longitudinal axis of the boot.

An example of a ski boot of this type is disclosed in German utility model DE-GM 87 02 920.0. In the ski boot according to this German patent document, two support elements are arranged between the shaft and the inner shoe and overlap one another in the region of the instep. The support elements cover the region of the instep in a saddle-like manner and, in the region of the ankle, they are supported for pivoting movement around an axis transverse to the longitudinal axis of the boot and parallel with the sole. The clamping device for the support elements includes a double-acting Bowden tackle, of which the sheath and pulling cable are, in each case, effectively connected with a support element in the region of the instep. A pivotable lever acts on the Bowden tackle. When this lever is actuated, the two support elements are displaced against one another in the region of the instep traverse to the longitudinal axis of the boot. With this ski boot, an adjustment of the support elements to the contours of the instep in the lengthwise, transverse and vertical directions are possible to a limited extent. A snug fit of the support elements against the inner shoe of the boot particularly in the region beneath the ankle is not possible.

The object of the present invention is to provide a sport shoe, in particular a ski boot, with support elements that are adaptable to any shape of foot, and which thus assures a snug fit of the foot in the boot.

The above object is accomplished in accordance with the present invention by providing a ski boot having a sole, a shaft portion attached thereto, a cushioning in the instep region, two support elements in the interior of the shaft overlapping one another and the cushioning longitudinally in a saddle-like manner in the instep region, and a clamping arrangement for displacing the support elements transversely relative to the longitudinal axis of the boot, wherein the front end regions of the support elements are connected with the boot shaft in the longitudinal direction of the boot and transversely thereto. The support elements are freely movable and, therefore, capable of adapting to any shape of foot, i.e., a high or low instep, an instep disposed more to the front or more to the back of the foot, and to a narrow or wide instep.

In a preferred embodiment, the support elements have centrally located slot-like recesses extending substantially parallel to the longitudinal axis of the boot. Additional recesses may be provided in the support elements extending obliquely to the sole of the boot. By these measures, the support elements are optimally adapted to the shape of the foot within the area of the instep, and, furthermore, they prevent high pressure from acting on the shin.

In another preferred embodiment, at least that part of the support element covering the outer region of the instep has a flap directed at the area beneath the ankle. This permits an adjustment of the support elements to the individual shape of a foot within this area as well.

In yet another embodiment, the support elements have, in their front end regions, oblong holes extending substantially parallel with the sole and approximately parallel with or oblique relative to the longitudinal axis of the boot, with guide members slidingly supported in such oblong holes. The guide members are also slidingly supported in a guide element in guide slots extending substantially transversely to the oblong holes. This gives the support elements the greatest unfettered movement possible.

In another particularly preferred embodiment, the spacing of the front end regions of the support elements from the shaft is adjustable. In this way, proper support of the foot in the boot is achieved also for the front part of the foot. This proper support is also achieved by varying the spacing of the guide element from the shaft.

The clamping arrangement has two pulling elements each engaging a support element preferably in the area laterally ahead of the ankle and gripping around the other support element and extending in the direction of the heel region. In this way, optimal transmission of the forces from the pulling elements to the support elements is achieved and, moreover, the support elements are pressed against the foot beneath the ankle, which produces excellent support in the boot.

In another preferred embodiment, the pulling elements are effectively connected with an actuating element arranged on or in the shaft. In this way, both pulling elements are adjusted by means of a single actuating element, which greatly simplifies the manipulation thereof.

Preferably, the actuating element has a self-locking rotary lock which simultaneously tensions or relieves the pulling elements. This permits a stepless and precisely controllable adjustment of the support elements.

In a particularly preferred embodiment, the clamping arrangement has two double-acting Bowden tackles, of which at least one acts in the center regions of the support elements. The second Bowden tackle may act on the two support elements in the center regions as well, or it may be effectively connected with the support elements in the more forward regions in the direction of the front end areas of such elements. This leads to a control adaptation of the support elements practically across the entire instep up into the toe area.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
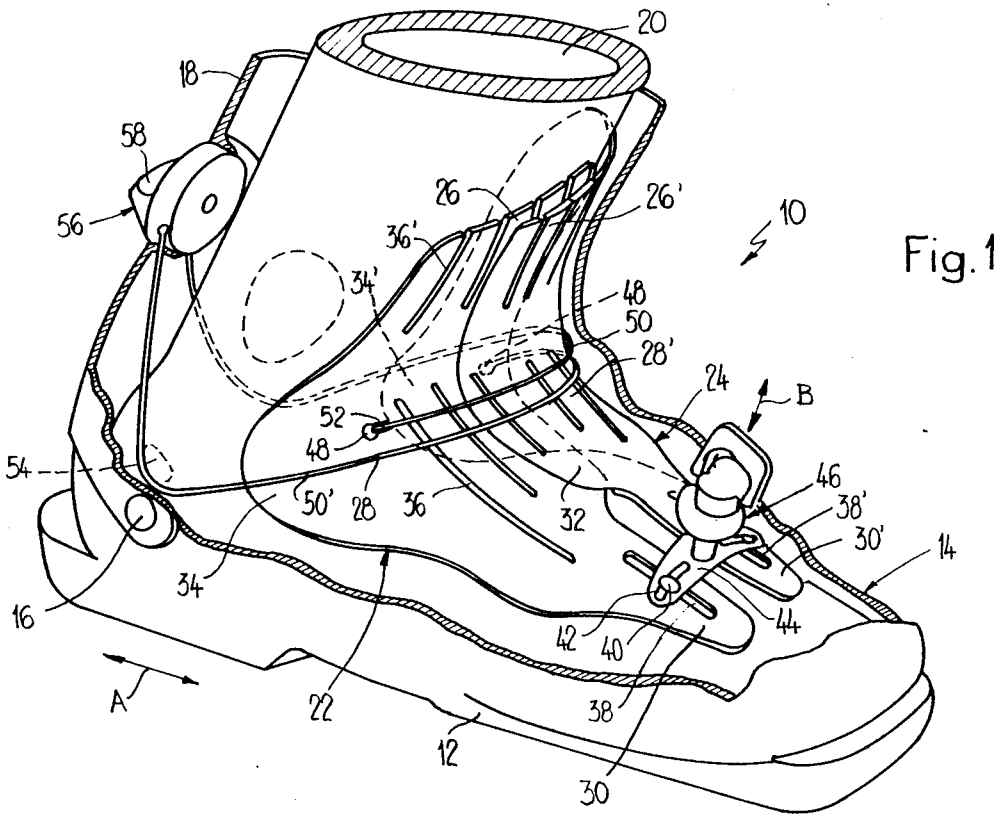
FIG. 1 is a perspective view of a ski boot partially cut-away and having two support elements displaceable by means of pulling elements.

Now turning to the drawings, there is shown in FIG. 1 a ski boot 10 with a part thereof cut-away. The boot has a sole 12 and a shaft 14, on which a rear shaft part 18 is supported beneath the skier's ankle by means of joints 16 which permit pivoting of rear shaft part 18 around an axis extending approximately parallel with sole 12 and transverse to the longitudinal direction A of the boot. A cushioned inner shoe 20 is arranged in the interior of shaft 14 and is covered saddle-like in the area of the instep by two support elements 22 and 24. The two support elements 22 and 24 overlap one another in their upper end areas 26 and 26' and center areas 28 and 28', in a direction approximately transverse to the longitudinal direction A of the boot, whereas front end areas 30 and 30' are spaced from one another in the direction extending transverse to the longitudinal direction A of the boot. Within the overlapping zone 32, the thickness of the support elements 22 and 24 is less than outside the overlapping zone 32. The support element 22 covering the outer area of the instep has a flap 34 directed against the area beneath the skier's ankle. Support element 24 covering the inner area of the instep is provided with a similar flap 34' shown in phantom. In the center areas 28 and 28' of support elements 22 and 24, provision is made for recesses 36, which are in the form of slots and extend parallel with the longitudinal direction A of the boot. In the upper end areas 26 and 26' of support elements 22 and 24, which are oblique relative to sole 12, recesses 36' are provided which extend up to the edge of support elements 22 and 24.

In the front end zones 30 and 30' of support elements 22 and 24, provision is made for an oblong hole 38 and 38', respectively, in each, extending substantially parallel with the longitudinal direction A of the boot. In each oblong hole 38 and 38', a guide bolt 40 is slidingly supported and slidingly guided in a guide slot 42 of a guide element 44 transverse relative to the longitudinal axis of the boot. Guide element 44 is arranged within the vicinity or region of the interdigital spaces of the skier's toes, extends substantially transverse relative to the longitudinal direction of the boot, and is actively connected to adjusting element 46. Adjusting element 46 is supported on shaft 14 and has an arrester 64, by means of which the spacing of guide element 44 from shaft 14 can be adjusted in the direction of arrow B substantially obliquely relative to sole 12, in a manner known per se.

Within the region laterally in front of the skier's ankle, pulling elements 50 and 50' are fastened on each support element 22 and 24 by means of a bayonet lock 48, which is only indicated in the drawing and not fully shown. Bayonet locks 48 are arranged in additional recesses 52 in support elements 22 and 24, so that they do not project beyond the latter. Pulling elements 50 and 50' extend from their respective bayonet lock 48 via the center regions 28' and 28 of the other respective support element 24 and 22 and around reversing elements 54, the latter being arranged within the region of the boot heel and shown in phantom, and up to a rotary lock 56. This rotary lock 56 is arranged in the rear shaft part 18 of shaft 14 and has a drum, on which the two pulling elements 50 and 50' are simultaneously wound by means of the rotation of an actuating lever 58. Rotary lock 56 is a self-locking device, so that pulling elements 50 and 50' are prevented from unwinding automatically.

Figure 3:
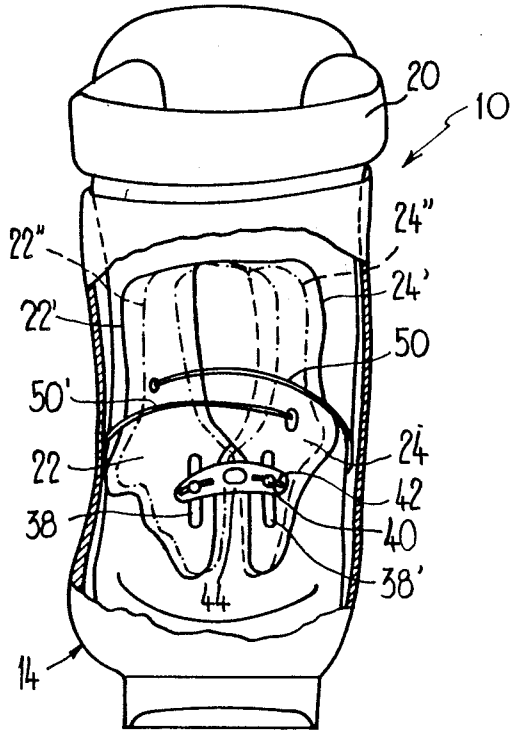
FIG. 3 is a front view of the ski boot of FIG. 1, with a part thereof cut-away.
Figure 2:
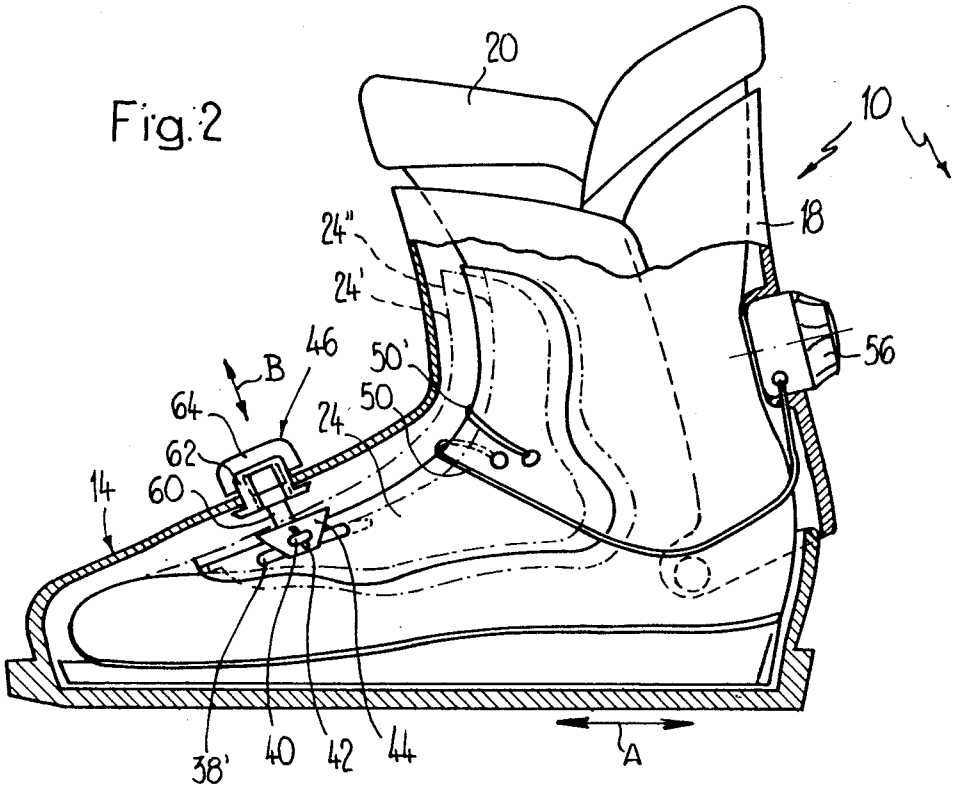
FIG. 2 is a side elevational view of the ski boot of FIG. 1 with a part thereof cut-away.

As clearly seen in FIGS. 2 and 3, support elements 22 and 24 are arranged between shaft 14 and inner shoe 20 and, as explained earlier herein, are actively connected with rotary lock 56 on rear shaft part 18 by means of pulling elements 50 and 50'. Front end zones 30 and 30' of support elements 22 and 24 are also slidingly supported on guide element 44 by means of oblong holes 38 and 38', guide bolt 40, and guide slots 42. A threaded bolt 60 is fastened on guide element 44 and a nut 62 of adjusting element 46, which is rotatably supported in shaft 14, is seated on bolt 60. Furthermore, adjusting element 46 has an arrester 64, which is torsionally rigidly connected with nut 62 and, for adjusting the spacing between shaft 14 and support elements 22 and 24 in the direction of arrow B, capable of swinging into an actuating position away from shaft 14, and back into a resting position on shaft 14 after the adjustment has been made. The position of support elements 22 and 24 adjusted for a high instep in a forward position is indicated in phantom by reference numerals 22' and 24', whereas a lower instep for a narrow foot in a rearward position is indicated in phantom by reference numerals 22" and 24".

Figure 4:
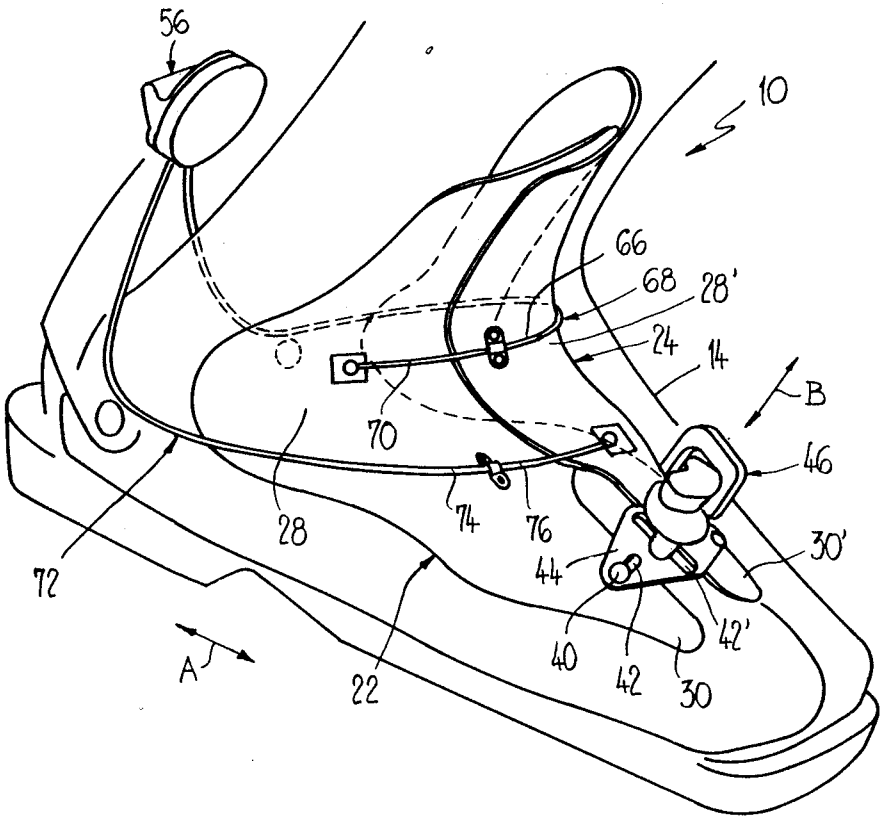
FIG. 4 is an embodiment of the ski boot according to the present invention that is slightly different than that shown in FIG. 1.

In FIG. 4 there is shown a simplified view of the ski boot 10 of FIG. 1, which is shown to be transparent. The spacing of support elements 22 and 24 in their front end regions 30 and 30' from shaft 14 is adjustable in the direction of arrow B by means of adjusting element 46. In the front end regions 30 and 30', guide bolts 40 are fixed on support elements 22 and 24, and are slidingly supported in guide slots 42 in guide element 44, with such guide slots extending transversely relative to the longitudinal axis of the boot. Guide element 44 is slidingly guided on adjusting element 46 by means of another guide slot 42' extending parallel with the longitudinal axis of the boot. Sheath 66 of a first Bowden, tackle 68, in center region 28', is actively connected with support element 24, whereas the flexible wire 70 is fastened on support element 22. A second Bowden tackle 72, with its sheath 74 and its flexible wire 76, acts on support elements 22 and 24, respectively, in the region of transition between the center areas 28 and 28' and the front end regions 30 and 30'. The two Bowden wires 68 and 70 extend to rotary lock 56, on which the sheaths 66 and 74 are supported, and by means of which wires 70 and 76 can be wound.

The adjustability and adaptability of support elements 22 and 24 are described as follows: Before stepping into the ski boot 10, the spacing in arrow direction B between the guide element 44 and shaft 14 is set to a minimum by the skier (cf. in particular FIGS. 1 and 2). The pulling elements 50 and 50', or flexible wires 70 and 76 of Bowden tackles 68 and 72, are loosened. In this condition, the support elements are practically resting against the inner wall of shaft 14, so that sufficient space is available to easily step into inner shoe 20. After clamping rear shaft part 18 against shaft 14 by means of known locks, support elements 22 and 24 can be adjusted. By rotating actuating lever 58 of rotary lock 56 (see FIG. 1), a tensile force is applied to pulling elements 50 and 50', or wires 70 and 76 (see FIG. 4), causing a displacement of support elements 22 and 24 in the direction transverse to the longitudinal direction A of the boot. By such displacement, support elements 22 and 24 adapt themselves to the shape of the foot in that they are supported, on the one hand, with free mobility in the longitudinal direction A and transverse thereto, and are capable of performing a tilting motion around guide element 44, on the other hand. In particular, it is to be noted that in the embodiment according to FIGS. 1 to 3, pulling elements 50 and 50' are guided in such a way that flaps 34 and 34' are forced or pressed against the foot in the area beneath the ankle, which gives the skier's foot particularly good support. Furthermore, the pressure in the area of the front part of the foot can be adjusted by means of adjusting member 46 as well. This permits a fine adjustment and, in turn, a painless and snug fit of the inner shoe on the foot within the area of support elements 22 and 24.

Concerning the embodiment according to FIG. 4, it is to be noted that in center regions 28 and 28', the two Bowden tackles 68 and 72 may act on the two support elements 22 and 24 parallel with one another, or, as shown in FIG. 4, the one Bowden tackle 68 may act on center zones 28 and 28' of support elements 22 and 24, and the second Bowden tackle 72 may act on the two support elements spaced from the first in the longitudinal direction A.

Also, guide bolts 40 may be fixed on guide element 44, which is slidingly supported on the adjusting element 46 by means of a guide slot 42', in a direction substantially parallel with the longitudinal direction A. In this case, guide bolts 40 slide in the oblong holes in the support elements 22 and 24, such holes extending transverse relative to the longitudinal direction A.

Furthermore, it is possible to dispense with adjusting element 46 and to arrange guide element 44 on shaft 14 with a fixed spacing from the latter. It is important that freedom of mobility of the front end regions 30 and 30' is assured in the lengthwise direction A and transversely thereto.

Obviously, rotary lock 56 need not necessarily be arranged on rear shaft part 18, but it can be fitted in some other location on shaft 14. Furthermore, rotary lock 56 may be replaced by some other type of lock capable of adjusting the pulling elements 50 and 50', or wires 70 and 76.

Furthermore, it is possible to make provision for only one flap 34 arranged on support element 22 covering the outer instep. Support element 24 covering the inner instep may be embodied without flap 34'.

The above-described support arrangements may be used in any ski boot or sport shoe. For example, it is possible to dispense with an inner shoe and to arrange a cushioning directly on support elements 22 and 24, or to arrange the support elements 22 and 24 between the shaft 14 and a cushioned tongue.

While only two embodiments of the present invention have been shown and described, it will be obvious that many changes and modifications may be made thereunto without departing from the spirit and scope of the invention.

What is claimed is:

1. A sport shoe, particularly a ski boot, comprising:
(a) a sole;
(b) a shaft attached to said sole;
(c) a cushioning in said shaft;
(d) two support elements within the interior of said shaft positioned saddle-like with respect to said cushioning in the region of the instep, said support elements overlapping each other in a region extending approximately in the longitudinal direction of said sport shoe;
(e) a clamping arrangement for displacing the support elements transversely relative to the longitudinal direction of the sport shoe so that when said support elements are moved towards each other of tightening, the overlap of the support elements is increased; and
(f) connecting means for connecting front end regions of said support elements with said shaft so as to permit movement of said support elements in the longitudinal direction of the sport shoe and transversely thereto.

2. The sport shoe as defined in claim 1, wherein the front end regions of said support elements are spaced from one another transversely relative to the longitudinal direction of the sport shoe and said support elements overlap one another at least in the center regions thereof joining the front end regions.

3. The sport shoe as defined in claim 2, which further comprises slot-like recesses extending substantially parallel to the longitudinal direction of the boot in the center regions of said support elements.

4. The sport shoe as defined in claim 3, which further comprises slot-like recesses in the top end regions of said support elements and extending substantially obliquely to said sole up to the edge of the support elements.

5. The sport shoe as defined in claim 2, wherein at least the support element covering the outer region of the instep is provided with a flap directed against the region beneath the ankle.

6. The sport shoe as defined in claim 2, wherein in the overlapping regions thereof, the thickness of the support elements is less than in the regions surrounding the overlapping regions.

7. The sport shoe as defined in claim 2, wherein said support elements have oblong holes in their front end regions extending substantially parallel with the sole and guide members slidingly supported in said oblong holes, said guide members also being slidingly supported in a guide element in guide slots extending substantially transversely relative to the oblong holes.

8. The sport shoe as defined in claim 7, wherein the oblong holes extend substantially parallel to the longitudinal direction of said sport shoe.

9. The sport shoe as defined in claim 7, wherein the oblong holes extend substantially transversely to the longitudinal direction of said sport shoe.

10. The sport shoe as defined in claim 2, wherein in the front end regions, guide members are fixed on said support elements, said guide members being slidingly supported in a guide element in guiding slots extending substantially parallel with the sole and transverse to the longitudinal direction of the sport shoe, and said guide element is slidingly supported substantially parallel with the longitudinal direction of the sport shoe.

11. The sport shoe as defined in claim 2, wherein the space between the front end regions of the support elements and the shaft is adjustable.

12. The sport shoe as defined in claim 7, wherein the spacing of said guide element from the shaft is variable.

13. The sport shoe as defined in claim 8, wherein the spacing of said guide element from the shaft is variable.

14. The sport shoe as defined in claim 12, wherein the spacing of said guide element from the shaft is adjustable by means of an adjusting element supported on the shaft and actuated outside the shaft.

15. The sport shoe as defined in claim 13, wherein the spacing of said guide element from the shaft is adjustable by means of an adjusting element supported on the shaft and actuated outside the shaft.

16. The sport shoe as defined in claim 1, wherein the clamping arrangement has two pulling elements each of which engages one support element in the region laterally in front of the ankle and grips around the other support element and extends in the direction of the region of the heel.

17. The sport shoe as defined in claim 16, wherein the support elements have additional recesses in which the pulling elements end and where the latter are fastened preferably by a bayonet lock arrangement.

18. The sport shoe as defined in claim 16, wherein said pulling elements are connected with an actuating element arranged on the shaft.

19. The sport shoe as defined in claim 18, wherein said actuating element has a preferably self-locking rotary lock for both tensioning and slackening the pulling elements.

20. The sport shoe as defined in claim 1, wherein said clamping arrangement comprises two double-action Bowden-type tackles, of which at least one acts on the support elements in the center regions thereof.

* * * * *